US005496232A

United States Patent [19]

Morris et al.

[11] Patent Number: 5,496,232

[45] Date of Patent: Mar. 5, 1996

[54] MODULAR PLAYGROUND EQUIPMENT SYSTEM

[76] Inventors: Denny W. Morris, 174AA Burney Mountain Rd., Falkville, Ala. 35622; David W. McNutt, Rte. 4, Box 84A, Tapscott Rd., Hartselle, Ala. 35640

[21] Appl. No.: 331,987

[22] Filed: Oct. 31, 1994

[51] Int. Cl.[6] ..... A63B 9/00

[52] U.S. Cl. ..... 482/35; 482/148; 52/263; 52/169.9

[58] Field of Search ..... 52/79.9, 79.12, 52/765, 263; 446/123; 248/107, 180, 183; 108/106, 192; 312/108, 110, 265.1, 128, 140

[56] References Cited

U.S. PATENT DOCUMENTS

| | | | |
|---|---|---|---|
| D. 83,716 | 3/1931 | Berman | 482/35 |
| 3,846,944 | 11/1974 | Lambert | 52/263 |
| 4,823,529 | 4/1983 | Canfield et al. | 52/263 |
| 5,151,069 | 9/1992 | Skalka | 482/35 |
| 5,226,864 | 7/1993 | Showers | 482/35 |
| 5,404,683 | 4/1995 | Hammond et al. | 52/263 |

FOREIGN PATENT DOCUMENTS

| | | | |
|---|---|---|---|
| 534058 | 3/1993 | European Pat. Off. | 482/35 |

*Primary Examiner*—Stephen R. Crow
*Assistant Examiner*—Jerome Donnelly
*Attorney, Agent, or Firm*—John C. Garvin, Jr.; James E. Staudt

[57] ABSTRACT

A module assembly mechanism 10 includes a platform 12 which supports all other members of the system. The platform 12 is constructed of four angular side connectors 14 which are attached at the ends 16 thereof so as to form a rectangular base 18. A support column 22 is rigidly attached to each corner of the base 18. Each of the support columns 22 includes an inner angle 24 and an outer angle 26 which angles are attached to one another by a weld bead 28 at the corners thereof. A stanchion 40 is rigidly attached to the outer angle 26 of each of the columns 22. Each stanchion 40 extends upwardly from the column 22 for connection to a roof module, and extends downwardly for contact with the ground or whatever foundation is provided for placement of the playground equipment. The module assembly mechanism 10 is adapted for attachment of a variety of commercially available playground equipment modules including lower level modules such as slides 52,54 and stairs 56,58 as well as upper level modules such as fish eye windows 60, safety rails 62, and tunnels 64.

10 Claims, 3 Drawing Sheets

MODULAR PLAYGROUND EQUIPMENT SYSTEM

BACKGROUND OF THE INVENTION

1. Field of the Invention

The invention relates to playground equipment, and more particularly to a playground apparatus incorporating modular construction which permits a simplified assembly and universal arrangement of playground equipment modules.

2. Description of Related Art

In the past playground equipment typically consisted of a single unit device such as a slide, a swing, a set of swinging bars or the like. These components were sometimes permanently combined during manufacture. Modern playground equipment however has become a conglomeration of many playground components or modules attached to one another by various means and in a variety of arrangements. These changes in playground equipment have evolved to meet the demands of a new generation of child care facilities. In the past most playground equipment was found in large school yards where space was plentiful and basic equipment was sufficient. However, with the ever increasing numbers of day care facilities, centers for children needing special training and many other child care facilities, the requirements for playground equipment to meet a great variety of needs have created a dilemma for the producers of the equipment. For example, if a user is providing equipment for use by special children the equipment must provide a higher than normal degree of safety, and may also be required to provide specialized training modules. The space requirements for these facilities also varies greatly. While one facility having a large playground to accommodate large numbers of children may require equipment having several varied components, another smaller operation may have limited space which requires the equipment to be limited to only one or a small number of components which must be specifically arranged to fit the available space.

While any playground equipment having a variety of components may obviously be assembled and disassembled, the equipment available prior to this invention does not lend itself to be quickly and easily assembled and custom designed to meet the varied needs of the present generation of equipment users.

In the sale of playground equipment, one most effective method is for a sales representative to transport a variety of available equipment to the location of a prospective buyer for display. Heretofore the equipment was completely fabricated at the factory. Because of the large bulk of the assembled equipment only a very limited variety of equipment could be easily transported. The present invention provides the capability of carrying a small number of module assembly mechanisms to which all playground modules may be attached, thus permitting simplified transportation of a large number of unattached playground modules of varied types. A further advantage relating to transportation is realized from the fact that the module assembly mechanism which is the subject of this invention, as well as playground modular components are configured for efficient stacking to reduce space requirements as well as shipping costs. In use of the present invention it will be readily understood that upon arrival at a display site, one or more of the module assembly mechanisms may be quickly assembled and any of the desired playground modules, such as slides, steps. game panels or the like, may be quickly and easily attached thereto for display and sale, or for an equally simple disassembly for further transportation.

Examples of related prior art are found in the following U.S. Pat. Nos. 4,262,900 to Vinson; 4,447,055 to Ahrens; and Des. 303,280 to Mercer.

The Vinson patent discloses an elevated house in combination with a variety of playground equipment components such as a slide, a teeter-totter, and a plurality of swings.

The Ahrens patent discloses playground equipment having a stairway, and a slide and utilizes a specialized fastening means for attaching the components thereof together.

The design patent to Mercer illustrates an elevated playhouse having a ladder attached thereto.

SUMMARY OF THE INVENTION

The invention is a unique modular construction apparatus which greatly enhances the building, efficient transportation, assembly and utility of modern playground equipment. More specifically the invention provides a unique nucleus around which a modular construction of playground equipment may be quickly and easily assembled. This nucleus is defined as a module assembly mechanism. This mechanism includes a platform which supports all other members of the system. The platform is constructed of four angular support links connected at the ends thereof so as to form a rectangular base for attachment thereto of a base plate which is configured to the approximate outer dimensions of the rectangular base. The base plate is positioned so as to cover the rectangular base and is attached to the rectangular base to provide rigid reinforcement thereof. As will be seen in more detail as the description continues, the base plate serves the additional function of providing a floor for use in an assembled playground apparatus. Support columns are rigidly but removably attached to the base. Each of the support columns includes an inner angle and an outer angle which are attached to one another by a weld bead at the corners thereof. Each inner angle is attached at the lower portion thereof to a corner of the base. A stanchion is rigidly but removably attached to each of the columns, and extends upwardly for connection to a roof module, and downwardly for contact with the ground or whatever foundation is provided for placement of the playground equipment. The module assembly mechanism is thus specifically adapted for quick and easy assembly of a variety of commercially available playground equipment modules such as stairways, slides, fish eye windows, safety rails, game devices and tunnels or walkways.

DESCRIPTION OF THE PREFERRED EMBODIMENT

Figure 1:
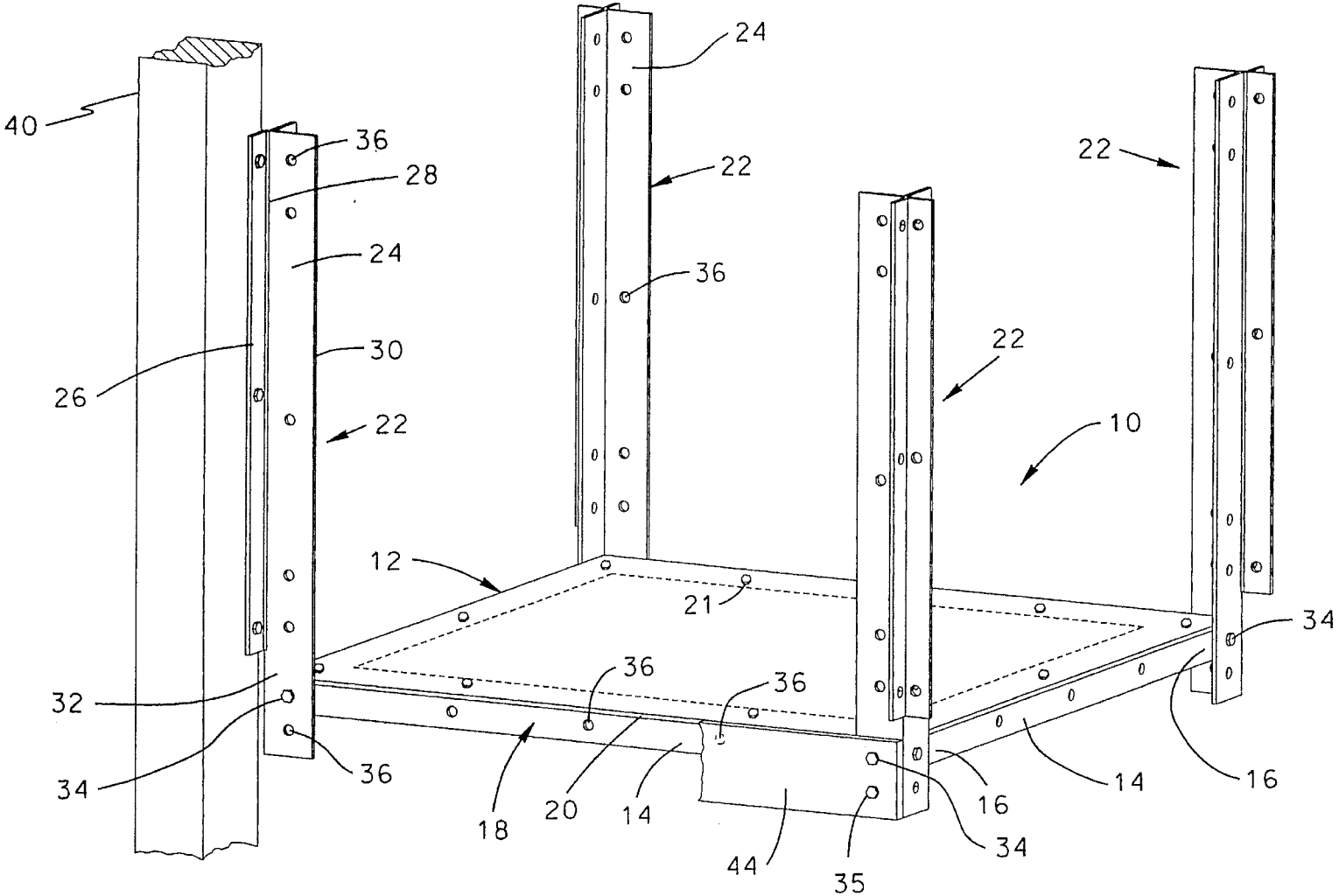
FIG. 1 is a perspective view of a modular assembly mechanism with portions thereof broken away.
Figure 3:
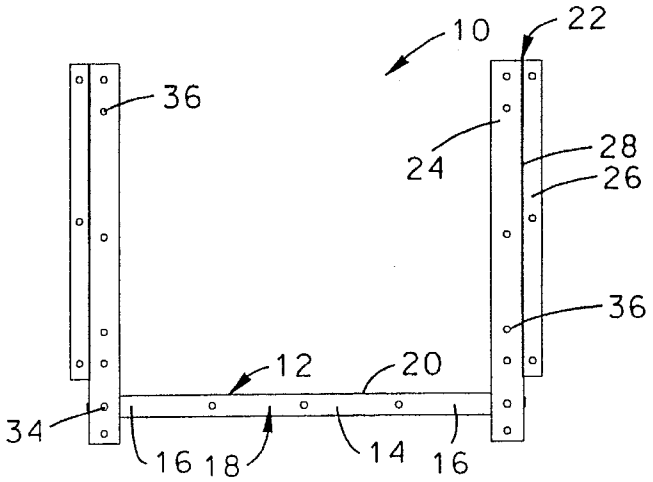
FIG. 3 is a front elevational view of the device as illustrated in FIG. 2.
Figure 4:
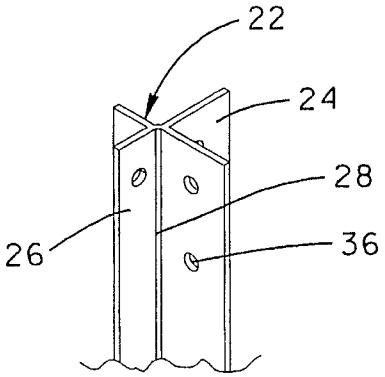
FIG. 4 is a an enlarged view of the upper end of a column as illustrated in FIGS. 1–3.
Figure 2:
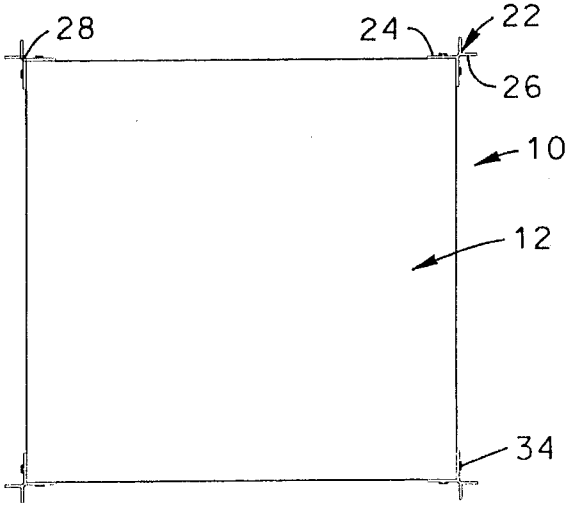
FIG. 2 is a top plan view of the basic frame work of the assembly illustrated in FIG. 1.
Figure 5:
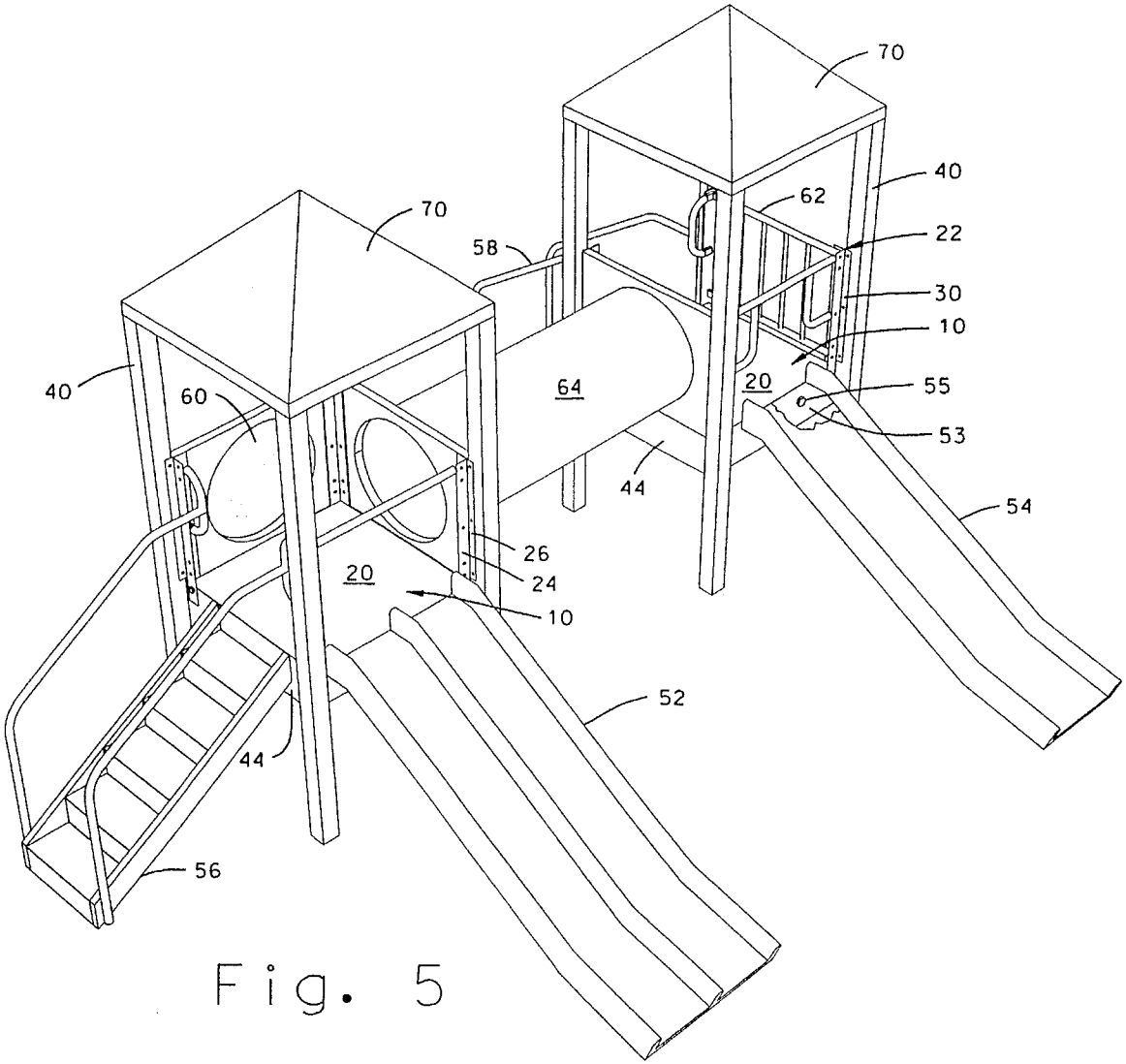
FIG. 5 is a perspective view of an assembled modular playground system showing playground equipment modules attached to the modular assembly mechanism illustrated in FIGS. 1–4.

Referring now to FIG. 1 of the drawing, this invention is defined as a module assembly mechanism 10. This mechanism includes a platform 12 which supports all other members of the system. The platform 12 is constructed of four angular side connectors 14 which are attached, such as by welding, at the ends 16 thereof so as to form a rectangular base 18. A base plate 20 is configured to the approximate outer dimensions of the rectangular base 18 and is attached thereto by bolts 21. The base plate 20 is positioned so as to cover the base 18 and is attached thereto to provide rigid reinforcement thereof. And as will be seen in more detail as the description continues, the base plate serves the additional function of providing a floor for use with attached playground equipment modules. As illustrated in FIGS. 1–3 a support column 22 is rigidly attached to each corner of the base 18. As best illustrated in FIGS. 1 and 4, each of the support columns 22 includes an inner angle 24 and an outer angle 26. These angles are attached to one another at the outside corners thereof by a weld bead 28. Each inner angle 24 has an upper portion 30 and a lower portion 32 and is attached at the lower portion thereof to each corner of the base 18 by bolts 34. It will be noted that the lower portion 32 of the inner angle 24 is defined generally as that portion which is attached to the base 18, while the upper portion 30 is defined generally as that portion to which the outer angle 26 is attached by weld bead 28. Elements of the module assembly mechanism 10 are provided with a plurality of strategically positioned apertures 36 for accommodation of bolts which serve as fastening means as described hereinafter. A stanchion 40 is rigidly attached to the outer angle 26 of each of the columns 22 (only one stanchion is shown in FIG. 1, for clarity). As illustrated in FIG. 5, each stanchion 40 extends upwardly from the platform 12 and is adapted at the upper terminal end thereof for connection to a roof module, and extends downwardly from the platform 12 a predetermined distance to its terminal lower end for contact with the ground or whatever foundation is provided for placement of the playground equipment. It is noted that the downward distance from the platform to the end of each stanchion 40 must duplicate the distance required for proper alignment and attachment of lower module playground equipment such as slides 52,54 and stairs 56. As illustrated the free end of each lower module is adapted to rest upon the surface which supports the playground equipment. As illustrated in FIGS. 1 and 5, a trim plate 44 is optionally attached to each of the lower portions 32 of the inner angles 24 by means of bolts 34 and 35 and is provided with additional apertures 36 which are aligned with the apertures of the side connectors 14.

As illustrated in FIG. 5 the component assembly mechanism 10 is adapted to receive a variety of commercially available playground equipment modules. More specifically, the side connectors 14 (best illustrated in FIGS. 1 and 3) of the module assembly mechanism are adapted for convenient attachment of lower level modules such as slides 52,54 and stairs 56,58. As also illustrated in FIG. 5 wherein a portion of the slide 54 is cut-away, each of the lower level modules include downwardly extending attachment plates 53 which are rigidly connected to the side connectors 14 by bolts 55. The upper portion 30 of each of the support columns 22, is adapted for reception of upper level modules such as fish eye windows 60, safety rails 62, and tunnels 64 or walkways (not illustrated). Items such as tunnels or walkways are utilized to connect two or more module assembly mechanisms 10 to provide a larger assortment of playground modular equipment such as may be required to accommodate large numbers of children.

In use it will be appreciated that the module assembly mechanism 12 is a unique design, the framework of which is constructed of readily available and inexpensive metal angles. In accordance with the invention, these angles may be quickly and simply assembled to form the framework which is extremely rigid and durable. It is also readily appreciated that this framework is uniquely adapted for providing the foundation of the module assembly mechanism. It should be noted that the addition of a base plate 20 substantially adds to the strength of the framework and also provides a floor which is utilized to cooperate with the playground modules which are to be attached to the module assembly mechanism. The framework of the module assembly mechanism is further strengthen by addition of the stanchions 40 at each corner thereof. As described above the lower ends of these stanchions contact the ground or whatever surface is provided to support the playground equipment. If desired the stanchions may be attached at the lower end to the support surface. Additional support is also provided by attachment of a roof module 70 at the upper ends of the stanchions 40.

It is noted that when transported, platforms 12 are included as assembled units which may be compactly stacked. All other components of the module assembly mechanism, as well as the modules themselves are also configured for compact packing. It is therefore clear that the disclosed invention is configured for efficient transportation. The invention also provides an economical and easily fabricated module assembly mechanism which is an extremely effective foundation for rapid attachment of playground equipment modules of all types. The ease of assembly both of the module assembly mechanism and of the attachment of the playground modules thereto is unmatched by any known device. In addition the fact that the invention is specifically configured for direct reception of playground equipment modules of many varieties is also a feature which heretofore was not provided by any known device. And finally as is obvious from the above description, when attached to the various playground equipment modules this invention interacts with the modules to increase the combined strength and durability of the integrated playground system.

Obviously, numerous modifications and variations of the present invention are possible in light of the above teachings. It is therefore to be understood that within the scope of the appended claims the invention may be practiced otherwise than as specifically described herein.

We claim:

1. A module assembly mechanism for connection of a variety of playground equipment modules comprising:

a platform including a base portion, a floor portion covering said base portion said base having a plurality of connector means disposed in spaced apart relation around the periphery of said platform and adapted for attachment to one of said playground equipment modules;

a plurality of upstanding columns each attached at one end thereof to said base portion and adapted at the other end thereof for attachment to at least one of said playground modules;

an upstanding stanchion attached to each of said columns, each said stanchion extending downwardly a predetermined distance from said platform so as to provide leg supports for said platform.

2. An assembly as set forth in claim 1 wherein said stanchions extend upwardly from said columns and are adapted for attachment at the upper end thereof to one of said playground equipment modules.

3. A module assembly mechanism for connection of a variety of playground equipment modules including a roof module, upper level modules and lower level module comprising:

a platform disposed for attachment to said lower level modules;

a plurality of support columns each having an outer angle and an inner angle, each said inner angle being attached to said platform and disposed for attachment to at least one of said upper level modules;

a plurality of stanchions each being attached to one said outer angle and having an upwardly extending portion extending upwardly from said platform and terminating at an upper end, and a downwardly extending portion extending downwardly from said platform and terminating at a lower end.

4. A mechanism as set forth in claim 3 wherein said platform includes a floor means, and is surrounded by a trim means.

5. A mechanism as set forth in claim 3 wherein said inner angle includes an upper portion and a lower portion, said upper portion being disposed for attachment thereto of at least one said upper level modules and said lower portion being attached to said platform.

6. A mechanism as set forth in claim 3 wherein the upper end of said stanchions are disposed for attachment to said roof module and wherein said lower end is disposed to support said module assembly mechanism.

7. A module assembly mechanism for connection of a variety of playground equipment modules comprising:

a platform including a base configured generally as a rectangle and including side connectors having a plurality of attachment means strategically located thereon, said side connectors having end portions and intermediate portions, said end portions of each of said side connectors being rigidly attached to one another so as to form corners of said base;

a base plate attached to said base, and being configured generally to cover said base;

a plurality of support columns, each of said support columns having an inner support angle and an outer support angle, the inner support angle of each of said support columns having upper and lower portions and being rigidly attached at the lower portion thereof to a corner of said platform base, and the upper portion of said inner support angle being adapted for attachment to selected of said playground equipment modules;

a plurality of stanchions having upper and lower ends, each of said stanchions being rigidly attached to the outer support angle of one of said support columns to support said platform a predetermined distance above the lower ends of said stanchions so as to accommodate the attachment of selected of said playground equipment modules directly to the intermediate portion of said side connectors.

8. A mechanism as set forth in claim 7 wherein the upper ends of said stanchions are adapted for attachment to one of said playground equipment modules.

9. A mechanism as set forth in claim 7 wherein said outer support angle is rigidly attached to the upper portion of said inner support angle.

10. A mechanism as set forth in claim 9 wherein said inner and outer support angles are attached at the outer corners of each of said angles.

* * * * *